US008784575B2

(12) United States Patent
Berlier et al.

(10) Patent No.: US 8,784,575 B2
(45) **Date of Patent: *Jul. 22, 2014**

(54) LOW PRESSURE CARBONITRIDING METHOD AND DEVICE

(71) Applicant: ECM Technologies, Grenoble (FR)

(72) Inventors: Jean Berlier, Saint Etienne de Saint Geoirs (FR); Aymeric Goldsteinas, Voreppe (FR); Xavier Doussot, Seyssins (FR)

(73) Assignee: ECM Technologies, Grenoble (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/657,112

(22) Filed: Oct. 22, 2012

(65) Prior Publication Data

US 2013/0042947 A1 Feb. 21, 2013

Related U.S. Application Data

(63) Continuation of application No. 11/918,805, filed as application No. PCT/FR2006/050357 on Apr. 19, 2006, now Pat. No. 8,303,731.

(30) Foreign Application Priority Data

Apr. 19, 2005 (FR) ..... 05 50996

(51) Int. Cl.
*C23C 8/34* (2006.01)

(52) U.S. Cl.
USPC ..... 148/218

(58) Field of Classification Search
USPC ..... 148/218
See application file for complete search history.

(56) References Cited

U.S. PATENT DOCUMENTS

| | | | |
|---|---|---|---|
| 3,892,597 | A | 7/1975 | Lincoln et al. |
| 4,035,203 | A | 7/1977 | L'Hermite et al. |
| 7,112,248 | B2 | 9/2006 | Yamaguchi |
| 8,303,731 | B2 | 11/2012 | Berlier et al. |
| 2004/0187966 | A1 | 9/2004 | Yamaguchi et al. |
| 2004/0250921 | A1 | 12/2004 | Yamaguchi |
| 2007/0069433 | A1 | 3/2007 | Jones |

FOREIGN PATENT DOCUMENTS

| | | | |
|---|---|---|---|
| DE | 19909694 | A1 | 9/2000 |
| EP | 1080243 | B1 | 3/2001 |
| FR | 2271295 | | 12/1975 |

OTHER PUBLICATIONS

International Search Report dated Sep. 1, 2006.

*Primary Examiner* — Jessee Roe
(74) *Attorney, Agent, or Firm* — Howard IP Law Group, PC

(57) ABSTRACT

A method for carbonitriding a steel part arranged in an enclosure maintained at a reduced internal pressure, the part being maintained at a temperature level, comprising an alternation of first and second steps, a carburizing gas being injected into the enclosure during the first steps only and a nitriding gas being injected into the enclosure only during at least part of at least two second steps.

7 Claims, 3 Drawing Sheets

LOW PRESSURE CARBONITRIDING METHOD AND DEVICE

CROSS REFERENCE TO RELATED APPLICATIONS

This application is a continuation application of U.S. patent application Ser. No. 11/918,805, filed on Jun. 22, 2009, now U.S. Pat. No. 8,303,731, entitled the same, which claims the benefit of Intl. Application No. PCT/FR2006/050357, filed Apr. 19, 2006 and French Application No. 05/50996, filed Apr. 19, 2005, the entire disclosures of which are incorporated herein by reference.

FIELD OF THE INVENTION

The present invention relates to methods for processing steel parts, and more specifically carbonitriding methods, that is, methods for introducing carbon and nitrogen at the surface of steel parts to improve their hardness and their fatigue behavior.

DISCUSSION OF PRIOR ART

There exist several types of methods for carbonitriding steel parts enabling introduction of carbon and nitrogen at the surface of parts, down to depths that can reach several hundreds of micrometers.

A first category of carbonitriding methods corresponds to so-called high-pressure carbonitriding methods since the enclosure containing the parts to be processed is maintained at a pressure generally close to the atmospheric pressure for the entire processing time. Such a method comprises, for example, maintaining the parts at a temperature level, for example, approximately 880° C., while feeding the enclosure with a gaseous mixture formed of methanol and ammonia. The carbonitriding step if followed by a quenching step, for example, an oil quenching, and possibly by a work hardening of the processed parts.

A second category of carbonitriding methods corresponds to so-called low-pressure or reduced-pressure carbonitriding methods, since the enclosure containing the parts to be processed is maintained at a pressure generally lower than a few hundreds of pascals (a few millibars).

US publication 2004/0187966 describes two examples of low-pressure carbonitriding methods.

FIG. 1 corresponds to FIG. 5(*a*) of US application 2004/0187966 and shows a curve 10 of variation of the temperature within a furnace enclosure in which a carbonitriding method according to a first embodiment comprising seven successive steps I to VII is carried out. The parts to be processed are heated (step I) up to a temperature level 12 and maintained at temperature level 12 (step II) to obtain a compensation of the temperatures of the parts. A carburizing step (step III) is carried out at temperature level 12 by the injection into the enclosure of an ethylene and hydrogen gaseous mixture and is followed by a diffusion step (step IV) performed at temperature level 12. The temperature in the enclosure is then lowered (step V) to a temperature level 14 lower than temperature level 12. A nitriding step (step VI) is performed at temperature level 14 by injecting ammonia into the enclosure. The parts are finally quenched (step VII), for example, by oil quenching.

FIG. 2 corresponds to FIG. 5(*b*) of US application 2004/0187966 and shows a curve 16 of variation of the temperature within a furnace in which a carbonitriding method according to a second example of embodiment comprising four successive steps I' to IV' is carried out. Steps I' and II' respectively correspond to steps I and II of the first embodiment. Step III' corresponds to a carbonitriding step, performed at a temperature level 18, during which a gaseous mixture of ethylene, hydrogen, and ammonia is injected into the furnace enclosure. Step IV' corresponds to an oil quenching step.

A disadvantage of the first carbonitriding method example described in US publication 2004/0187966 is that the nitriding step is performed after the carburizing step, at a temperature level lower than the carburizing temperature level. The total processing time may thus be excessively long, which makes the use of such a method in an industrial context difficult.

A disadvantage of the second carbonitriding method example described in US publication 2004/0187966 is due to the fact that the carburizing and nitriding gases are injected simultaneous into the furnace enclosure. It is then difficult to accurately control the gaseous environment in the enclosure and, accordingly, to accurately and reproducibly control the nitrogen and carbon concentration profiles obtained in the processed parts.

SUMMARY OF THE INVENTION

The present invention provides a method of low-pressure carbonitriding of steel parts which enables accurately and reproducibly obtaining the desired carbon and nitrogen concentration profiles in the processed parts.

Another object of the present invention is to provide a carbonitriding method having an implementation compatible with the processing of steel parts in an industrial context.

The present invention also aims at a low-pressure steel part carbonitriding furnace enabling accurately and reproducibly obtaining the desired carbon and nitrogen profiles in the processed parts.

Another object of the present invention is to provide a low-pressure carbonitriding furnace of simple design.

For this purpose, the present invention provides a method for carbonitriding a steel part arranged in an enclosure maintained at a reduced internal pressure, the part being maintained at a temperature level. The method comprises an alternation of first and second steps, a carburizing gas being injected into the enclosure during the first steps only and a nitriding gas being injected into the enclosure only during at least part of at least two second steps.

According to an embodiment, the carburizing gas is propane or acetylene and the nitriding gas is ammonia.

According to an embodiment, a neutral gas is injected into the enclosure simultaneously with the nitriding gas.

According to an embodiment, the nitriding gas is injected into the enclosure during at least a second step for a time shorter than the duration of said second step, the rest of the second step being carried out in the presence of a neutral gas.

According to an embodiment, the first and second steps are performed at a constant pressure lower than 1,500 pascals.

According to an embodiment, the temperature level ranges between 800° C. and 1050° C.

According to an embodiment, the temperature level is higher than 900° C.

The present invention also provides a carbonitriding furnace intended to receive a steel part, the furnace being associated with gas introduction and gas extraction means controlled to maintain a reduced internal pressure, and comprising heating means for maintaining the part at a temperature level. The introduction means comprise means for introducing, during an alternation of first and second steps carried out at said temperature level, a carburizing gas during the first steps only and a nitriding gas only during at least part of at least one second step.

According to an embodiment, the introduction means comprise means for introducing a neutral gas.

BRIEF DESCRIPTION OF THE DRAWINGS

The foregoing and other objects, features, and advantages of the present invention will be discussed in detail in the following non-limiting description of specific embodiments in connection with the accompanying drawings, among which.

DETAILED DESCRIPTION

The present invention comprises carrying out in an enclosure containing steel parts to be processed maintained at a substantially constant temperature, an alternation of carbon enrichment steps during which a carburizing gas is injected into the enclosure under a reduced pressure and of carbon diffusion steps during which the carburizing gas injection is interrupted.

The present invention comprises providing the injection, into the enclosure, of a nitriding gas for all or part of the carbon diffusion steps. The carbon enrichment steps then correspond to nitrogen diffusion steps. The nitriding gas is injected during at least part of at least two carbon diffusion steps, that is, during at least part of a carbon diffusion step interposed between two carbon enrichment steps. This advantageously enables accurately and reproducibly controlling the carbon and nitrogen concentration profiles obtained in the processed parts, since the nitriding gas injection is performed separately from the carburizing gas injection. Further, since the nitriding gas injection is performed during the carbon diffusion steps, the total duration of the carbonitriding processing is substantially similar to a conventional carburizing processing.

Figure 1:
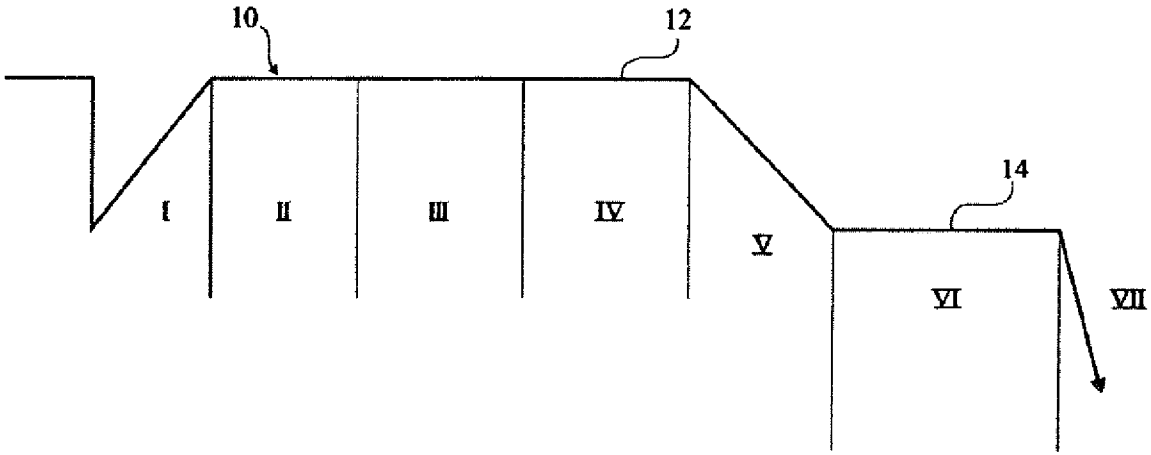
FIGS. 1 and 2, previously described, illustrate conventional low-pressure carbonitriding method examples.
Figure 2:
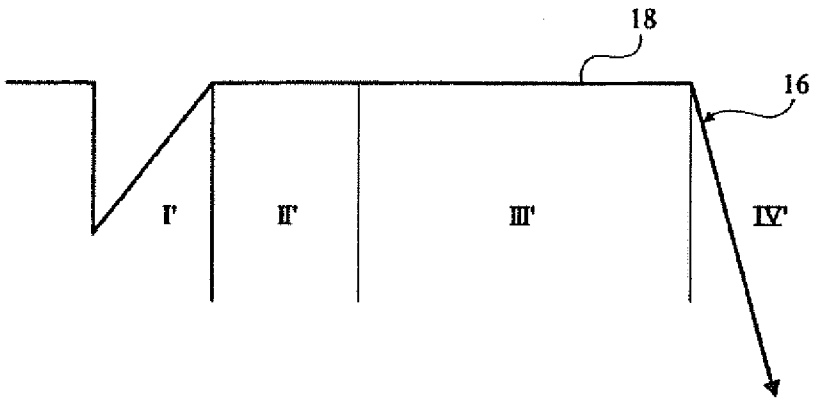
Figure 3:
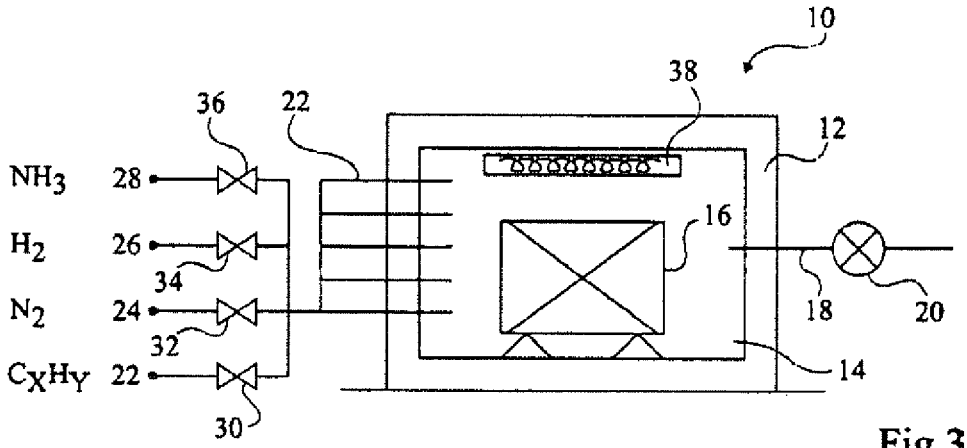
FIG. 3 schematically shows an embodiment of a low-pressure carbonitriding furnace according to the present invention.

FIG. 3 schematically shows an embodiment of a low-pressure carbonitriding furnace 10 according to the present invention. Furnace 10 comprises a tight wall 12 delimiting an internal enclosure 14 in which is arranged a load to be processed 16, generally a large number of parts arranged on an appropriate support. A vacuum on the order of a few hundreds of pascals (a few millibars) can be maintained in enclosure 14 due to an extraction pipe 18 connected to an extractor 20. An injector 22 enables introducing gases in distributed fashion into enclosure 14. Gas inlets 22, 24, 26, 28 respectively controlled by valves 30, 32, 34, 36 have been shown as an example. The temperature in enclosure 14 may be set by heating means 38.

Figure 4:
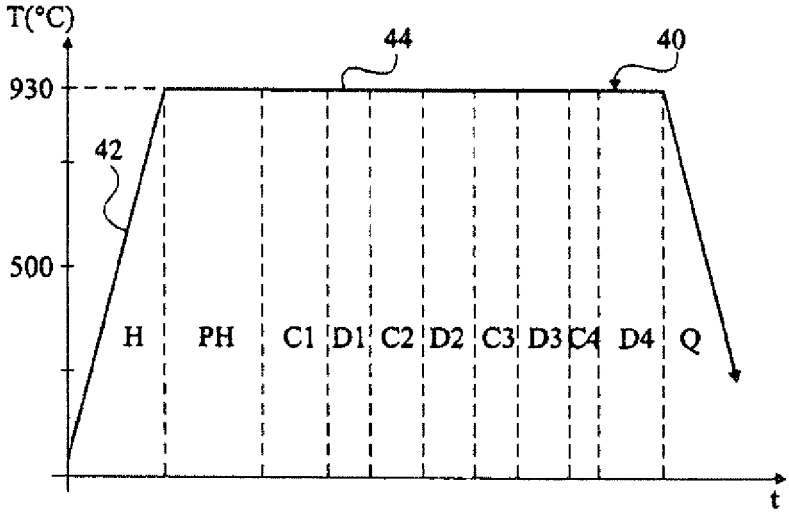
FIG. 4 illustrates an example of a low-pressure carbonitriding method according to the present invention.

FIG. 4 shows a curve 40 of the temperature variation in enclosure 14 of carbonitriding furnace 10 of FIG. 3 during a carbonitriding cycle according to an example of a carbonitriding method of the invention. The method comprises an initial step H corresponding to a rise 42 in the temperature in enclosure 14 containing load 16 up to a temperature level 44 which, in the present example, is equal to 930° C. and which can generally correspond to temperatures ranging between approximately 800° C. and approximately 1050° C. Step H is followed by a step PH of temperature compensation of the parts forming load 16 at temperature level 44. Steps H and PH are carried out in the presence of a neutral gas, to which a reducing gas may be added. The neutral gas for example is nitrogen ($N_2$). The reducing gas, for example, hydrogen ($H_2$), may be added according to a proportion varying within a range from 1% to 5% in volume of the neutral gas. For security reasons, it may be desirable to limit the hydrogen proportion to proportions lower by approximately 5% to prevent any risk of explosion in the case where hydrogen would incidentally come into contact with the surrounding air.

Step PH is followed by an alternation of carbon enrichment steps C1 to C4, during which a carburizing gas is injected into enclosure 14, and of carbon diffusion steps D1 to D4, during which the carburizing gas is no longer injected into enclosure 14. As an example, four enrichment steps C1 to C4 and four diffusion steps D1 to D4 are shown in FIG. 4. The enrichment and diffusion steps are carried out by maintaining the temperature in enclosure 14 at temperature level 44. During diffusion steps D1 to D4, an injection of a nitriding gas into enclosure 14 is performed. A step of quenching Q of load 10, for example, a gas quenching, closes the carbonitriding cycle. During steps H, PH, enrichment steps C1 to C4 and diffusion steps D1 to D4, a vacuum is maintained in enclosure 14 at pressures of a few hundreds of pascals (a few millibars). According to a variation of the invention, during each carburizing step, the carburizing gas injection is performed by pulses.

The carburizing gas for example is propane ($C_3H_8$) or acetylene ($C_2H_2$). It may also be any other hydrocarbon ($C_XH_Y$) likely to dissociate at the enclosure temperatures to carburize the surface of the parts to be processed. The nitriding gas for example is ammonia ($NH_3$). Referring to the diagram of FIG. 3, a hydrocarbon ($C_XH_Y$) may be made to arrive on inlet 22 of valve 30, nitrogen may be made to arrive on inlet 24 of valve 32, hydrogen may be made to arrive on inlet 36 of valve 34, and ammonia may be made to arrive on inlet 28 of valve 36.

The nitriding gas injection may be performed during some of the diffusion steps only. Further, during a diffusion step during which nitriding gas is injected, the nitriding gas injection may be performed for part only of the diffusion step. A neutral gas, for example, nitrogen ($N_2$), may be injected for all of the enrichment and diffusion steps, only during the diffusion steps, or only during part of the diffusion steps. The neutral gas injection is regulated to maintain the pressure in enclosure 14 constant. When the nitriding gas and the neutral gas are simultaneously injected, the relative proportions of the nitriding gas and of the neutral gas are determined according to the desired nitrogen concentration profile in the processed parts. Further, the relative proportions of the nitriding gas and of the neutral gas may be different for each diffusion step during which nitriding gas and neutral gas are simultaneously injected into enclosure 14.

According to an alternative embodiment of the present invention, all the gases injected into enclosure 14 of furnace 10 or some of them may be mixed before injection into enclosure 14. Such a variation for example enables, during steps of temperature rise H and of temperature compensation PH, directly injecting into enclosure 14 a nitrogen and hydrogen mixture of the type containing a hydrogen proportion lower than 5% in volume, such a hydrogen proportion excluding any risk of explosion.

According to the present embodiment of the present invention, the carbonitriding method is implemented with no pressure variation and the injections of the carburizing gas and of the nitriding gas (and/or possibly of the neutral gas), during enrichment and diffusion steps, are successive and the substitution between the carburizing gas and the nitriding gas (and/or possibly the neutral gas) is likely to occur very fast.

Figure 5:
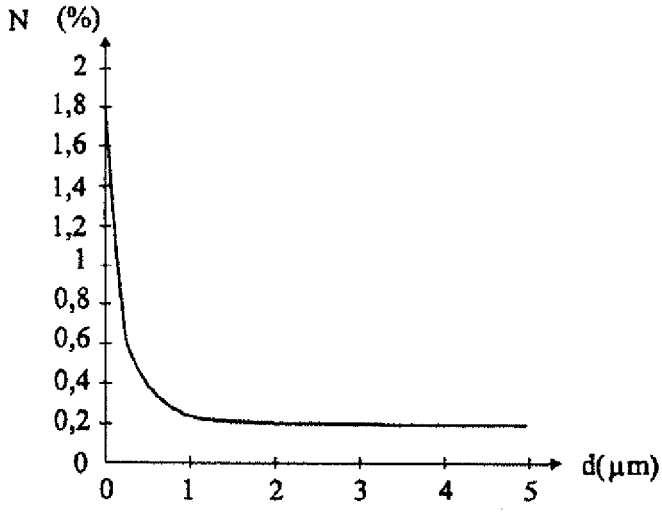
FIG. 5 shows an example of a nitrogen concentration profile obtained in steel parts processed according to an example of low-pressure carbonitriding method of the invention.

FIG. 5 shows an example of a mass concentration profile of the nitrogen element having diffused into a processed part according to the depth, measured from the surface of the part, when the carburizing gas is propane and the nitriding gas is ammonia.

Figure 6:
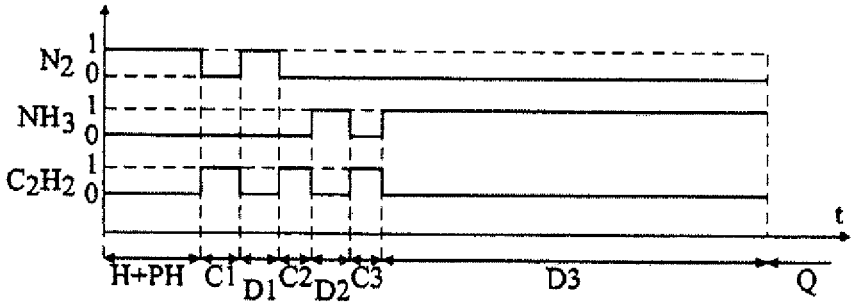
FIGS. 6, 7, and 8 respectively illustrate another example of a carbonitriding method according to the present invention and the carbon and nitrogen concentration profiles obtained for such a carbonitriding method.
Figure 7:
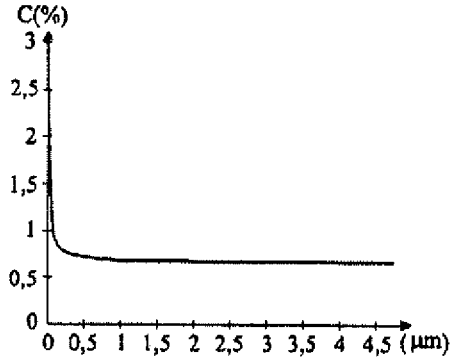
Figure 8:
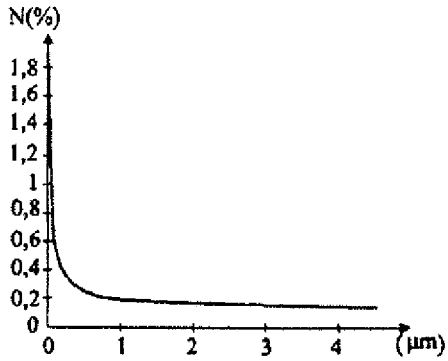

FIGS. 6, 7, and 8 respectively illustrate an example of a carbonitriding method according to the present invention and the carbon and nitrogen concentration profiles obtained for such a carbonitriding method in which the carburizing gas is acetylene and the nitriding gas is ammonia. In the present example, the carbonitriding is performed at a 880° C. temperature level. As an example, the steps of heating H and of temperature compensation PH last for 20 minutes and are followed by an alternation of three enrichment steps C1, C2, C3 (respectively of 123 s, 51 s, and 49 s) and of three diffusion steps D1, D2, D3 (respectively of 194 s, 286 s, and 2,957 s).

Figure 9:
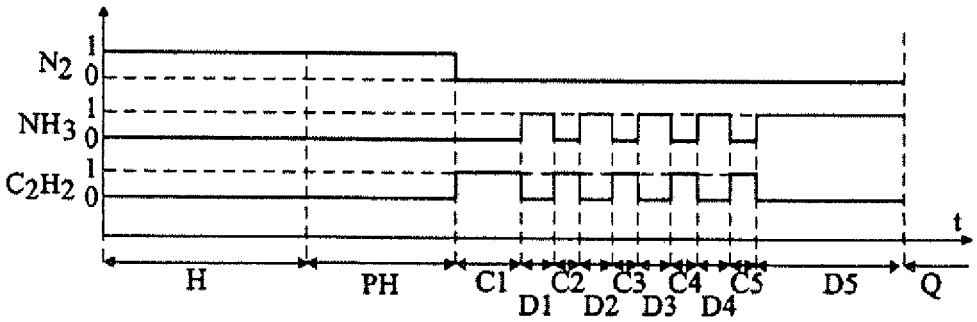
FIGS. 9, 10, and 11 respectively illustrate another example of a carbonitriding method according to the present invention and the carbon and nitrogen concentration profiles obtained for such a carbonitriding method.
Figure 10:
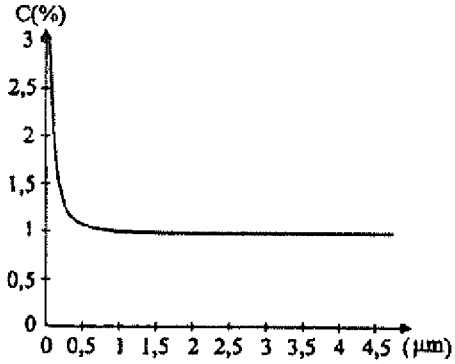
Figure 11:
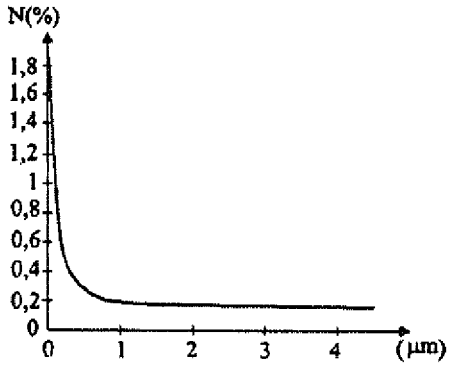

FIGS. 9, 10, and 11 respectively illustrate another example of a carbonitriding method according to the present invention and the carbon and nitrogen concentration profiles obtained for such a carbonitriding method, in which the carburizing gas is acetylene and the nitriding gas is ammonia. In the present example, the carbonitriding is performed at a 930° C. temperature level. The steps of heating H and of temperature compensation PH respectively last for 29 minutes and 31 minutes and are followed by an alternation of five enrichment steps C1 to C5 (respectively of 329 s, 91 s, 80 s, 75 s, and 71 s) and of five diffusion steps D1 to D5 (respectively of 108 s, 144 s, 176 s, 208 s, and 2,858 s).

The applicant has shown that the ammonia injection during the diffusion steps enables enrichment of the carburized layer with nitrogen down to a depth of several hundreds of micrometers. For the three shown examples, the obtained nitrogen content is on the order of 0.2% in weight at a depth of a few micrometers. The nitrogen content then slowly decreases from 0.2% for several hundreds of micrometers. As an example, for the embodiment previously described in relation with FIGS. 6, 7, and 8, the nitrogen concentration is on the order of 0.2% at 30 μm, of 0.14% at 60 μm, of 0.12% at 130 μm, and of 0.05% at 200 μm.

According to a variation of the present invention, the nitriding gas may be injected during temperature rise step H, as soon as the temperature in enclosure 14 exceeds a given temperature, and/or during temperature compensation step PH. As an example, when the nitriding gas is ammonia, the injection may be performed as soon as the temperature in enclosure 14 exceeds approximately 800° C.

The fact of injecting the nitriding gas during the carbon diffusion steps only enables better nitrogen and carbon enrichment of the processed parts and enables accurately and reproducibly obtaining the desired carbon and nitrogen concentration profiles. Indeed, if the nitriding gas is injected simultaneously with the carburizing gas, a dilution of the carburizing gas and of the nitriding gas occurs. This factor does not promote the reaction of the carbon originating from the carburizing gas or the reaction of the nitrogen originating from the nitriding gas with the parts to be processed, which slows down the enrichment of the parts with nitrogen and with carbon. Further, if the carburizing gas and the nitriding gas are mixed, it is difficult to accurately control the gaseous environment in enclosure 14, which makes the accurate and reproducible obtaining of the nitrogen and carbon concentration profiles of the parts difficult. Further, since the diffusion of nitrogen into steel parts is, for same processing conditions, faster than the carbon diffusion, the injection of the nitriding gas and of the carburizing gas at distinct steps enables more easily modifying the injection duration of each gas while ensuring the maintaining of a constant pressure in enclosure 14.

Of course, the present invention is likely to have various alterations and modifications which will occur to those skilled in the art. As an example, the previously-described gas quenching step may be replaced with an oil quenching step.

The invention claimed is:

1. A method for carbonitriding a steel part arranged in an enclosure maintained at a reduced internal pressure, the part being maintained at a temperature level, the method comprising: an alternation of first and second steps, in which each of the first steps is followed by one of the second steps, a carburizing gas being injected into the enclosure during the first steps only and a nitriding gas being injected into the enclosure only during at least part of at least two second steps, the nitriding gas being injected into the enclosure during at least a second step for a time shorter than the duration of said second step, the rest of the second step being carried out in the presence of a neutral gas.

2. The method of claim 1, wherein the carburizing gas is propane or acetylene.

3. The method of claim 1, wherein the nitriding gas is ammonia.

4. The method of claim 1, wherein a neutral gas is injected into the enclosure simultaneously with the nitriding gas.

5. The method of claim 1, wherein the first and second steps are performed at a constant pressure lower than 1,500 pascals.

6. The method of claim 1, wherein the temperature level is in the range of 800° C. and 1050° C.

7. The method of claim 1, wherein the temperature level is higher than 900° C.

* * * * *